US009296095B2

(12) United States Patent
Yoshino et al.

(10) Patent No.: US 9,296,095 B2
(45) Date of Patent: Mar. 29, 2016

(54) ROTARY TOOL

(71) Applicant: MAX CO., LTD., Tokyo (JP)

(72) Inventors: Motoki Yoshino, Tokyo (JP); Yasuyuki Uchiyama, Tokyo (JP); Kenichi Arai, Tokyo (JP); Kazuya Sakamaki, Tokyo (JP)

(73) Assignee: MAX CO., LTD., Tokyo (JP)

( * ) Notice: Subject to any disclaimer, the term of this patent is extended or adjusted under 35 U.S.C. 154(b) by 444 days.

(21) Appl. No.: 13/736,995

(22) Filed: Jan. 9, 2013

(65) Prior Publication Data

US 2013/0186666 A1 Jul. 25, 2013

(30) Foreign Application Priority Data

Jan. 23, 2012 (JP) ..... 2012-011358

(51) Int. Cl.

| | |
|---|---|
| ***B25B 21/02*** | (2006.01) |
| ***B25B 23/14*** | (2006.01) |
| ***B25B 21/00*** | (2006.01) |
| ***B25B 23/147*** | (2006.01) |
| ***B25F 5/00*** | (2006.01) |
| *B25B 23/18* | (2006.01) |

(52) U.S. Cl.

CPC ..... *B25B 21/02* (2013.01); *B25B 21/00* (2013.01); *B25B 23/14* (2013.01); *B25B 23/1475* (2013.01); *B25F 5/001* (2013.01); *B25B 23/18* (2013.01)

(58) Field of Classification Search

CPC ..... B25B 21/02; B25B 21/00; B25B 23/14; B25B 23/144; B25B 23/1475; B23Q 5/08; B23Q 5/28; B25F 5/01; B23B 45/02

USPC ..... 173/2, 48, 217, 20, 178, 176, 183, 47, 173/201; 388/811, 930, 937, 819, 909; 318/599, 432, 434, 430, 490; 81/467, 81/469, 470; 73/862.23, 862.338, 379.01

See application file for complete search history.

(56) References Cited

U.S. PATENT DOCUMENTS

| | | | | |
|---|---|---|---|---|
| 5,963,707 | A | 10/1999 | Carr | |
| 6,467,355 | B1 * | 10/2002 | Leong | B23P 19/042 73/761 |
| 6,687,567 | B2 * | 2/2004 | Watanabe | 700/168 |
| 6,968,908 | B2 * | 11/2005 | Tokunaga | B25B 21/02 173/181 |
| 6,978,846 | B2 * | 12/2005 | Kawai | B23P 19/066 173/176 |
| 7,036,703 | B2 * | 5/2006 | Grazioli et al. | 227/10 |
| 7,082,866 | B2 * | 8/2006 | Becker | B25B 23/1425 702/151 |

(Continued)

FOREIGN PATENT DOCUMENTS

| | | |
|---|---|---|
| JP | A-H10-180643 | 7/1998 |
| JP | 2006-062065 A | 3/2006 |

(Continued)

*Primary Examiner* — Scott A. Smith

(74) *Attorney, Agent, or Firm* — Drinker Biddle & Reath LLP

(57) ABSTRACT

A rotary tool is provided with a mode selecting part that selects one operating mode from a predetermined plurality of operating modes when a mode switching button is pressed. The plurality of operating modes include: a first auto stop mode where a motor rotates only for a first time period after an impacting operation is detected; and a second auto stop mode where the motor rotates only for a second time period which is shorter than the first time period after the impacting operation is detected.

8 Claims, 3 Drawing Sheets

(56) References Cited

U.S. PATENT DOCUMENTS 7,331,406 B2 * 2/2008 Wottreng et al. ..... 173/176
7,410,007 B2 * 8/2008 Chung et al. ..... 173/48
7,521,892 B2 * 4/2009 Funabashi ..... H01M 2/1022 320/114
7,551,411 B2 * 6/2009 Woods ..... B24B 23/028 318/434
7,556,103 B2 * 7/2009 Matsunaga ..... 173/2
7,673,701 B2 * 3/2010 Tanaka ..... B25B 21/00 173/4
7,942,211 B2 * 5/2011 Scrimshaw et al. ..... 173/48
8,025,106 B2 * 9/2011 Schmidt ..... B25B 21/00 173/1
8,074,731 B2 * 12/2011 Iwata ..... B25B 21/02 173/109
8,272,452 B2 * 9/2012 Katou et al. ..... 173/2
8,616,299 B2 * 12/2013 Ichikawa ..... 173/2
8,674,640 B2 * 3/2014 Suda et al. ..... 318/430
8,678,106 B2 * 3/2014 Matsunaga et al. ..... 173/176
8,689,900 B2 * 4/2014 Miwa et al. ..... 173/176
8,919,456 B2 * 12/2014 Ng et al. ..... 173/11
2001/0052416 A1 * 12/2001 Wissmach ..... B23Q 3/15546 173/4
2002/0060082 A1 5/2002 Watanabe
2010/0194315 A1 8/2010 Kusakawa

FOREIGN PATENT DOCUMENTS

JP A-2007-007852 1/2007
JP 2011-067910 A 4/2011
WO WO 2011-013852 2/2011
WO WO 2011-102559 8/2011

* cited by examiner

ROTARY TOOL

CROSS REFERENCE TO RELATED APPLICATION

This application claims priority to Japanese Patent Application No. 2012-011358 filed on Jan. 23, 2012, the entire contents of which are incorporated by reference herein.

BACKGROUND OF THE INVENTION

1. Field of the Invention

The present invention relates to a rotary tool.

2. Related Art

Generally, a rotary tool such as an impact wrench is rotated only while a trigger is pulled, and is stopped rotating when the trigger is released. In a case a bolt is tightened by the rotary tool, there is a problem that the bolt is excessively tightened and thus elongated when the trigger is pulled for a long time. Further, there is also a problem that electricity is wasted when the trigger is pulled unnecessarily and thus an amount of available operations per a single electric charge is decreased.

In order to avoid the above problems, there is a rotary tool whose rotational movement is automatically stopped in a predetermined condition. For example, JP-A-2006-062065 discloses an electric rotary tool configured as follows. That is, a load current value or a voltage value for an electric motor is preset, which corresponds to an optimal screw tightening torque value depending on a type of a screw, a signal to determine the type of screw is generated when taking out a selected screw from a screw supply part, the load current value or voltage value of the electric motor corresponding to the optimal screw tightening torque value for the selected screw is automatically selected and set, and a drive stop control is carried out when the screw tightening with the optimal screw tightening torque by the electric motor is completed.

However, the rotary tool disclosed has a problem that variation occurs in the load current value or voltage value depending on each operator and thus the automatic stop does not necessarily obtain the intended result. Further, there is also a problem that it is difficult for the operator to adjust conditions of the automatic stop depending on a situation in a site and therefore usability is poor.

SUMMARY OF THE INVENTION

One or more embodiments provide a rotary tool capable of switching conditions of an automatic stop in a manner easy to understand and without complicated operations, depending on a work.

DETAILED DESCRIPTION OF THE EMBODIMENTS

Exemplary embodiments will be described with reference to the accompanying drawings.

Figure 1:
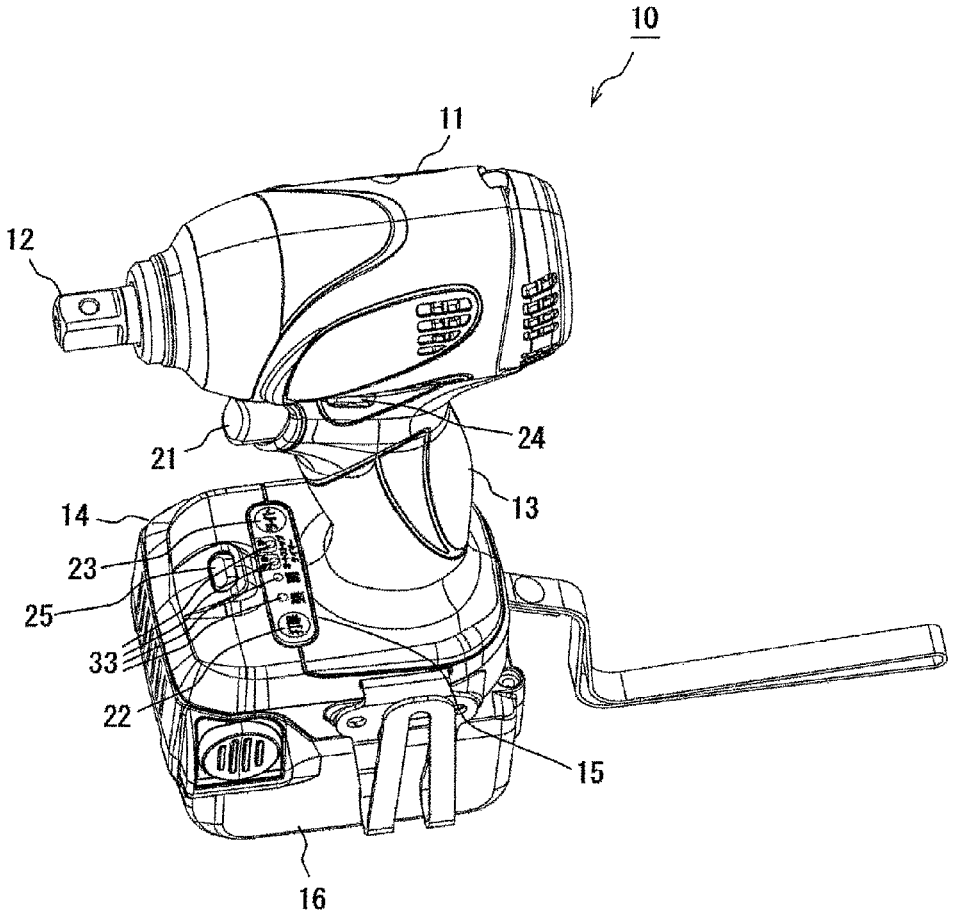
FIG. 1 is an external view of a rotary tool.

A rotary tool 10 according to the present embodiment is an impact wrench equipped with a motor 31. The rotary tool 10 includes a cylindrical output unit 11, a grip 13 which is provided on a lower portion of the output unit 11 and extends in a direction substantially perpendicular to the output unit 11 and a battery pack attachment 14 provided on a lower portion of the grip 13, as shown in FIG. 1.

Although not particularly shown, the motor 31 is accommodated in the output unit 11. A spindle, an impact mechanism and an anvil are provided in series coaxially with a rotation shaft of the motor 31. An output shaft 12 is formed at a leading end portion of the anvil. A socket or a bit (not shown) can be mounted to the output shaft 12. As the socket or the bit is rotated by a driving force of the motor 31, a bolt or nut held by the socket or the bit is rotated and thus can be screwed.

The impact mechanism is a mechanism which is provided coaxially with the rotating shaft of the motor 31 in order to convert the rotation of the spindle into a rotational impact force. The impact mechanism is configured by a hammer and a compression spring, etc. The impact mechanism receives a rotating force of the motor 31, converts the rotating force into a rotational impact force and transmits the rotational impact force to the anvil which is rotatably supported on a hammer case.

Although not particularly shown, a plurality of LEDs as a second lamp 32 to irradiate a working place is arranged around the output shaft 12.

The grip 13 is a portion for grasping the rotary tool 10. Near the boundary of the grip 13 with the output unit 11, a trigger 21 is arranged at the front and a rotation direction determining lever 24 is arranged at the rear, as shown in FIG. 1.

The trigger 21 is intended to operate the rotary tool 10. As the trigger 21 is pulled, the motor 31 is rotated and thus the rotary tool 10 is started to operate. The trigger 21 is placed at a position where an index finger is correctly positioned when grasping the grip 13.

Further, the rotation direction determining lever 24 is intended to determine a rotation direction of the motor 31 and arranged so that left and right ends protrude from the side surfaces of the grip 13. The rotation direction determining lever 24 is adapted to slide in a direction perpendicular to the output shaft 12 by an operation to push either of the left and right ends. The rotation direction determining lever 24 is formed so that the motor 31 is rotated in a forward direction when one of the left and right ends is pushed and the motor 31 is rotated in a reverse direction when the other of the left and right ends is pushed.

The battery pack attachment 14 is a portion having a lower surface on which a battery pack 16 is removably attached. As shown in FIG. 1, an operation panel 15 and a first lamp 25 are provided on an upper surface side of the battery pack attachment 14.

The operation panel 15 is provided with a mode displaying lamp 33 for displaying a current operating mode, a mode switching button 22 for changing an operating mode and a light switching button 23 for lighting the first lamp 25 and the second lamp 32.

The light switching button 23 is intended to switch the illumination intensity of the first lamp 25 and the second lamp 32 every time when being pressed. As the light switching button 23 is operated, the first lamp 25 and the second lamp 32 are lit and thus it is possible to work safely and reliably even when working at a dark place.

A control board is accommodated within the battery pack attachment 14 located at a back side of the operation panel 15 and connected to each button of the operation panel 15 or a lamp. A control device 100 (see FIG. 2) is mounted on the control board and configured to control the operation of the rotary tool 10.

Although not particularly shown, the control device 100 is mainly configured by a CPU. Further, the control device 100 is configured to process the input of various switches or the like and thus to control the drive of the motor 31 or the like.

Figure 2:
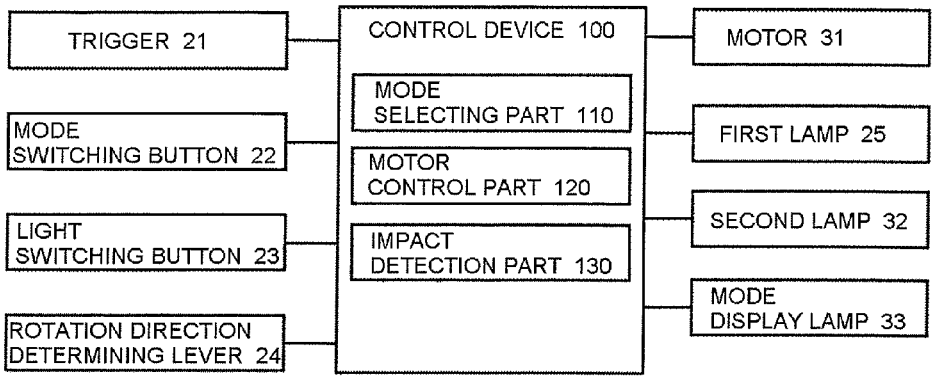
FIG. 2 is a system block diagram of the rotary tool.

As shown in FIG. 2, the control device 100 is connected to the trigger 21, the mode switching button 22, light switching button 23 and the rotation direction determining lever 24, which are input devices.

Further, the control device 100 is connected to the motor 31, the first lamp 25, the second lamp 32 and the mode displaying lamp 33, which are output devices.

In addition, the control device 100 executes the program stored in a ROM and thus serves as each of a mode selecting part 110, a motor control part 120 and an impact detection part 130.

The mode selecting part 110 sequentially shifts the operating modes when the mode switching button 22 is pressed. In this way, the mode selecting part 110 is adapted to select any operating mode from a predetermined plurality of operating modes.

The rotary tool 10 according to the present embodiment includes four operating modes as an operating mode, that is, a "High-Power mode (first continuous rotation mode)", a "Low-Power mode (second continuous rotation mode)", a "three seconds auto stop mode (first auto stop mode)" and a "one second auto stop mode (second auto stop mode)". Four mode displaying lamps 33 of the operation panel 15 are provided corresponding to each of the four operating modes and only the mode displaying lamp 33 to display the current operating mode is to be lit.

Figure 3:
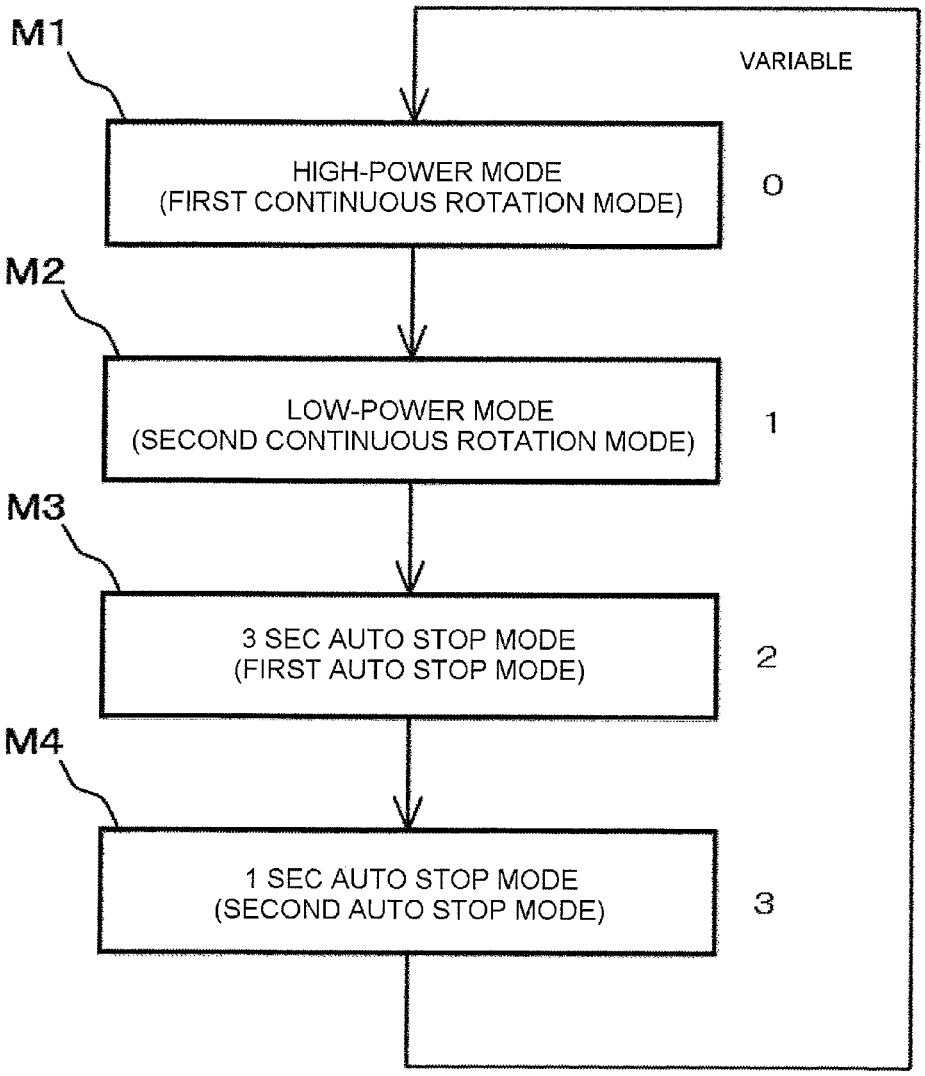
FIG. 3 is a flowchart showing transition in the operation modes of the rotary tool.

As shown in FIG. 3, the mode selecting part 110 changes the operating modes in the order of "the High-Power mode"→"the Low-Power mode"→"the three seconds auto stop mode"→"the one second auto stop mode" every time when the mode switching button 22 is pressed. Further, the operating mode returns to "the High-Power mode" when the mode switching button 22 is pressed in "the one second auto stop mode".

Internal processing in this case is as follows.

That is, as the mode switching button 22 is pressed, a mode switching signal is outputted to the mode selecting part 110. The mode selecting part 110 updates the variables according to the operating modes every time when receiving the mode switching signal one time. For example, as shown in FIG. 3, a variable "0" is assigned to "the High-Power mode", a variable "1" is assigned to "the Low-Power mode", a variable "2" is assigned to "the three seconds auto stop mode", and a variable "3" is assigned to "the one second auto stop mode". And, when the mode switching signal is received in a state of variable "0", the variable is incremented by one and thus set as "1". Further, when the mode switching signal is received in a state of variable "1", the variable is incremented by one and thus set as "2". Further, when the mode switching signal is received in a state of variable "2", the variable is incremented by one and thus set as "3". Further, when the mode switching signal is received in a state of variable "3", the variable is reset as "0".

By this internal processing, the operating mode is changed in the order of "the High-Power mode"→"the Low-Power mode"→"the three seconds auto stop mode"→ "the one second auto stop mode" every time when receiving the mode switching signal one time. When the mode switching signal is received in "the one second auto stop mode", the operating mode is migrated to "the High-Power mode".

When the operating mode is changed in this way, the indication of the mode displaying lamp 33 is also changed correspondingly and thus it is possible to visually confirm the current operating mode.

The motor control part 120 is adapted to control the rotation of the motor 31 in accordance with the operating mode selected by the mode selecting part 110. That is, the motor control part 120 receives a control signal from the trigger 21 to rotate the motor 31 when the trigger 21 is pulled to a predetermined position. At this time, the motor control part 120 rotates the motor 31 in the control according to the operating mode, with reference to the operating mode (that is, the variable according to the operating mode set by the mode selecting part 110) selected by the mode selecting part 110.

Further, the rotation direction of the motor 31 at this time is switched in accordance with the state of the rotation direction determining lever 24 mentioned above. That is, the motor 31 is rotated in a forward direction when the rotation direction determining lever 24 is located in a forward rotation position and the motor 31 is rotated in a reverse direction when the rotation direction determining lever 24 is located in a reverse rotation position.

The impact detection part 130 detects the impacting operation of the impact mechanism. That is, when the motor 31 is started to rotate by pulling the trigger 21 to the predetermined position, the impact detection part 130 detects the impacting operation by monitoring whether the impacting operation of the impact mechanism has been performed or not.

The impact detection part 130 in the present embodiment detects the impacting operation of the impact mechanism by detecting load of the motor 31. Specifically, the impact detection part 130 detects that the impacting operation of the impact mechanism has been performed, by detecting that the load of the motor 31 is larger than a predetermined value when the current value supplied to the motor 31 exceeds a predetermined value.

As described above, the rotary tool 10 according to the present embodiment includes four rotation modes of "the High-Power mode", "the Low-Power mode", "the three seconds auto stop mode" and "the one second auto stop mode".

"The High-Power mode" is a mode for use in a high-load work such as a work of tightening a normal bolt or a work of using a thick bolt. "The High-Power mode" is a continuous rotation mode where the motor 31 is rotated from the time when the trigger 21 is pulled to the time when the pulled trigger is released.

"The Low-Power mode" is a mode for use in a delicate work requiring a fine adjustment, such as a work of tightening a thin bolt. "The Low-Power mode" is also a continuous rotation mode where the motor 31 is rotated from the time when the trigger 21 is pulled to the time when the pulled trigger is released.

"The three seconds auto stop mode" is a mode (first auto stop mode) where the motor 31 is rotated only for approximately three seconds and then stopped after the trigger 21 is pulled one time and the impacting operation is detected by the impact detection part 130. This mode is set as a time to allow a spring washer to be flattened when tightening the spring washer together with a strap bolt (M12) to be used in a wooden house or the like. In the present embodiment, the rotation speed per time in "the three seconds auto stop mode" is set substantially the same as that in "the High-Power mode".

"The one second auto stop mode" is a mode (second auto stop mode) where the motor 31 is rotated only for approximately one second and then stopped after the trigger 21 is pulled one time and the impacting operation is detected by the impact detection part 130. This mode is set to achieve approximately 50 Newtons by tightening M12 bolt •nut to be used in a structure such as a rebar house. In the present embodiment, the rotation speed per time in "the one second auto stop mode" is set substantially the same as that in "the High-Power mode".

According to the present embodiment, as described above, the three seconds auto stop mode (the first auto stop mode) where the motor 31 is rotated for a predetermined time period (i.e. first time period; e.g. three seconds) and then stopped after the trigger 21 is pulled and the impacting operation is detected by the impact detection part 130 and the one second auto stop mode (the second auto stop mode) where the motor 31 is rotated for a specific time period (i.e. second time period; e.g. one second) shorter than the predetermined time period and then stopped after the trigger 21 is pulled and the impacting operation is detected by the impact detection part 130 can be switched simply by operating the mode switching button 22 for switching an operating mode. Accordingly, it is possible to switch the conditions of the automatic stop in a manner easy to understand and without complicated operations, depending on the work.

Particularly, in an impact wrench, since both bolt and nut are made of metal, a screw is broken if retightening is too strong. However, according to the present embodiment, the retightening can be performed in a short time as necessary and thus there is no problem that the screw is broken. Further, adjustment of the retightening can be easily switched and performed simply by pushing the mode switching button 22.

Although two operating modes are provided as the auto stop mode and two operating modes are provided as the continuous rotation mode in the above embodiment, the present invention is not limited to this configuration. For example, three or more operating modes may be provided as the auto stop mode.

Further, although the operating modes are sequentially shifted every time when pushing the mode switching button 22 in the above embodiment, the present invention is not limited to this configuration. A mode switching button corresponding to each of the operating modes may be provided.

Further, although the rotation speed per time in each auto stop mode is set substantially the same as that in "the High-Power mode" in the above embodiment, the present invention is not limited to this configuration. For example, the rotation speed per time may be changed to any rotation speed by providing a separate changeover switch or the like.

Further, although the time of each auto stop mode is set as the predetermined time period (three seconds) and the specific time period (one second) in the above embodiment, the present invention is not limited to this configuration. For example, the time of the auto stop mode may be changed to any time by providing a separate changeover switch or the like.

Further, although not particularly described in the above embodiment, an automatic stop by the torque detection in the continuous rotation mode may be employed. That is, although it is assumed that the motor 31 is rotated from the time when the trigger 21 is pulled to the time when the pulled trigger is released in the continuous rotation mode, a control in which the motor 31 is stopped when the load current value or voltage value to be monitored exceeds a threshold may be employed.

Further, although the impact detection part 130 detects that the impacting operation of the impact mechanism has been performed, by detecting that the load of the motor 31 is larger than a predetermined value when the current value supplied to the motor 31 exceeds a predetermined value in the above embodiment, the embodiment of the present invention is not limited to this configuration.

For example, the impact detection part 130 may detect that the impacting operation of the impact mechanism has been performed, by detecting the change in the rotation speed of the motor 31 and thus detecting that the load of the motor 31 is larger than a predetermined value.

Further, the impact detection part 130 may detect that the impacting operation of the impact mechanism has been performed, by detecting both the current value supplied to the motor 31 and the change in the rotation speed of the motor 31.

Further, the present invention is not limited to an embodiment for detecting the load of the motor 31 but may detect that the impacting operation of the impact mechanism has been performed, by detecting that the sound or vibration value during the impacting operation becomes a predetermined value.

Further, although the motor 31 is rotated for the predetermined time period or the specific time period after the impacting operation is detected by the impact detection part 130 in the above embodiment, the present invention is not limited to this configuration.

For example, the motor 31 may be rotated for the predetermined time period or the specific time period after the trigger 21 is pulled. By this configuration, in a case of a rotary tool with no impact mechanism or in a case of performing a work without a time lag, the retightening can be performed for a predetermined time period or a specific time period after the trigger 21 is pulled to a predetermined position, without determining whether the impacting operation of the impact mechanism has been performed or not.

In the rotary tool 10 including the impact detection part 130, the presence or absence of the time lag of the auto stop may be switched by providing a switch for switching the presence or absence of the detection determination for the impacting operation of the impact mechanism. That is, a switch may be provided for switching the timing when a predetermined time period or a specific time period is started to be measured to either the detection timing by the impact detection part 130 or the detection timing by the pulling operation of the trigger 21.

Further, a given preliminary operation time may be provided before the trigger 21 is pulled and thus the first auto stop mode and the second auto stop mode are performed. In this preliminary operation time, the rotation speed of the motor 31 may be varied according to the pulling amount of the trigger 21. When the rotation speed of the motor 31 is varied according to the pulling amount of the trigger 21, it is possible to reduce the rotation speed of the motor 31, as compared to during the execution the first auto stop mode or the second auto stop mode. Accordingly, the rotation speed of the motor 31 can be increased gradually and thus it is possible to effectively prevent the come-out phenomenon. That is, since the bolt or nut can be damaged (the come-out phenomenon) when the motor is suddenly rotated at a high-speed during the retightening, it is general that the motor is rotated at a low-speed and a small torque as an initial operation by reducing the pulling amount of the trigger, in order to prevent such a phenomenon. However, such an initial operation can be carried out in the preliminary operation time and thus it is possible to effectively prevent the come-out phenomenon.

The preliminary operation time can be set in advance and set to about 0.5 to 1 second, for example. Since the time required for the initial operation is different for each operator, this preliminary operation time may be arbitrarily switched (for example, 0.3 to 3 seconds). In this case where the preliminary operation time can be arbitrarily switched, a switch for setting the time may be provided.

In accordance with embodiments, a rotary tool 10 may include: a motor 31; an impact mechanism provided coaxially with a rotation shaft of the motor 31; an impact detection part 130 configured to detect an impacting operation of the impact mechanism; a mode switching button 22 configured to switch an operating mode; a mode selecting part 110 configured to select one operating mode from a predetermined plurality of operating modes when the mode switching button 22 is pressed; and a motor control part 120 configured to control the motor 31 in accordance with the operating mode selected by the mode selecting part 110. The plurality of operating modes may include: a first auto stop mode where the motor 31 rotates only for a first time period after the impacting operation is detected by the impact detection part 130, when the trigger 21 is pulled, and a second auto stop mode where the motor 31 rotates only for a second time period which is shorter than the first time period after the impacting operation is detected by the impact detection part 130, when the trigger 21 is pulled.

According to the structure, the first auto stop mode where the motor is rotated for a predetermined time period and then stopped after the trigger is pulled and the impacting operation is detected by the impact detection part and the second auto stop mode where the motor is rotated for a specific time period shorter than the predetermined time period and then stopped after the trigger is pulled and the impacting operation is detected by the impact detection part can be switched simply by operating the mode switching button for switching an operating mode. Accordingly, it is possible to switch the conditions of the automatic stop in a manner easy to understand and without complicated operations, depending on the work. Further, since the predetermined time period or the specific time period for the auto stop is started to be measured from the time when the impacting operation has been performed, it is possible to carry out retightening for a constant time after the impacting operation has been reliably performed.

The impact detection part 130 may detect the impacting operation of the impact mechanism by detecting a load of the motor 31.

According to the structure, the impact detection part detects the impacting operation of the impact mechanism by detecting load of the motor. Accordingly, it is possible to reliably detect the impacting operation by detecting the load directly applied to the rotary tool.

The impact detection part 130 may detect the load of the motor 31 by detecting either or both an electric current value supplied to the motor 31 and a rotation speed of the motor 31.

According to the structure, the impact detection part detects the load of the motor by detecting either or both the current value supplied to the motor and the rotation speed of the motor. Accordingly, a detailed control can be performed by the detected value.

The impact detection part 130 may detect the impacting operation of the impact mechanism by detecting a sound or a vibration during the impacting operation by a sensor.

According to the structure, the impact detection part detects the impacting operation of the impact mechanism by detecting sound or vibration during the impacting operation by the sensor. Accordingly, it is possible to reliably detect the impacting operation by directly detecting the sound or vibration generated by the rotary tool.

In accordance with embodiments, a rotary tool 10 may include: a motor 31; a mode switching button 22 configured to switch an operating mode; a mode selecting part 110 configured to select one operating mode from a predetermined plurality of operating modes when the mode switching button 22 is pressed; and a motor control part 120 configured to control the motor 31 in accordance with the operating mode selected by the mode selecting part 110. The plurality of operating modes may include: a first auto stop mode where the motor 31 rotates only for a first time period after trigger 21 is pulled, when the trigger 21 is pulled, and a second auto stop mode where the motor 31 rotates only for a second time period which is shorter than the first time period after trigger 21 is pulled, when the trigger 21 is pulled.

According to the structure, the first auto stop mode where the motor is rotated for a predetermined time period and then stopped when the trigger is pulled and the second auto stop mode where the motor is rotated for a specific time period shorter than the predetermined time period and then stopped when the trigger is pulled can be switched simply by operating the mode switching button for switching an operating mode. Accordingly, it is possible to switch the conditions of the automatic stop in a manner easy to understand and without complicated operations, depending on the work. Further, since transition to each of the auto stop modes can be made approximately at the same time when the trigger is pulled, an actual work without a time lag can be performed in a rotary tool having no impact mechanism, for example.

The plurality of operating modes may further include: a continuous rotation mode where the motor 31 is rotated from the time when the trigger is pulled to the time when the pulled trigger is released.

According to the structure, the plurality of operating modes further include the continuous rotation mode where the motor is rotated from the time when the trigger is pulled to the time when the pulled trigger is released. Accordingly, a continuous work can be performed while not interrupting the rotation of the motor by using the continuous rotation mode.

A preliminary operation time may be provided before the first auto stop mode or the second auto stop mode are performed.

According to the structure, a given preliminary operation time is provided before the trigger is pulled and thus the first auto stop mode and the second auto stop mode are performed. Accordingly, an initial operation can be performed prior to a retightening operation which is performed at a constant rotation speed for the predetermined time period or the specific time period. When the motor is rotated at a low-speed in the initial operation, there is no case that the motor is suddenly rotated at a high-speed and thus the retightening operation is performed. Accordingly, it is possible to effectively prevent a come-out phenomenon.

What is claimed is:

1. A rotary tool comprising:

a motor;

an impact mechanism provided coaxially with a rotation shaft of the motor;

an impact detection part configured to detect an impacting operation of the impact mechanism;

a mode switching button configured to switch an operating mode;

a mode selecting part configured to select one operating mode from a predetermined plurality of operating modes when the mode switching button is pressed; and a motor control part configured to control the motor in accordance with the operating mode selected by the mode selecting part, wherein the plurality of operating modes include:

a first auto stop mode where the motor rotates only for a first time period after the impacting operation is detected by the impact detection part, when the trigger is pulled, and a second auto stop mode where the motor rotates only for a second time period which is shorter than the first time period after the impacting operation is detected by the impact detection part, when the trigger is pulled.

2. The rotary tool according to claim 1, wherein the impact detection part is configured to detect the impacting operation of the impact mechanism by detecting a load of the motor.

3. The rotary tool according to claim 2, wherein the impact detection part is configured to detect the load of the motor by detecting either or both an electric current value supplied to the motor and a rotation speed of the motor.

4. The rotary tool according to claim 1, wherein the impact detection part is configured to detect the impacting operation of the impact mechanism by detecting a sound or a vibration during the impacting operation by a sensor.

5. The rotary tool according to claim 1, wherein the plurality of operating modes further include:

a continuous rotation mode where the motor is rotated from the time when the trigger is pulled to the time when the pulled trigger is released.

6. A rotary tool comprising:

a motor;

a mode switching button configured to switch an operating mode;

a mode selecting part configured to select one operating mode from a predetermined plurality of operating modes when the mode switching button is pressed; and a motor control part configured to control the motor in accordance with the operating mode selected by the mode selecting part, wherein the plurality of operating modes include:

a first auto stop mode where the motor rotates only for a first time period after trigger is pulled, when the trigger is pulled, and a second auto stop mode where the motor rotates only for a second time period which is shorter than the first time period after trigger is pulled, when the trigger is pulled.

7. The rotary tool according to claim 6, wherein the plurality of operating modes further include:

a continuous rotation mode where the motor is rotated from the time when the trigger is pulled to the time when the pulled trigger is released.

8. The rotary tool according to claim 6, wherein a preliminary operation time is provided before the first auto stop mode or the second auto stop mode are performed.

* * * * *